US006220494B1

(12) United States Patent
Raffoni

(10) Patent No.: US 6,220,494 B1
(45) Date of Patent: Apr. 24, 2001

(54) APPARATUS FOR INSERTING METAL BACKING ELEMENT RETAINING STAPLES IN THE MOLDING OF PICTURE-FRAMES

(76) Inventor: Giuseppe Raffoni, Via Bolognesi 24, 47100 Forli' (IT)

( * ) Notice: Subject to any disclaimer, the term of this patent is extended or adjusted under 35 U.S.C. 154(b) by 0 days.

(21) Appl. No.: 09/479,217

(22) Filed: Jan. 7, 2000

(30) Foreign Application Priority Data

Jan. 14, 1999 (IT) ..... BO99A0013

(51) Int. Cl.[7] ..... B27F 7/09

(52) U.S. Cl. ..... 227/2; 227/6; 227/7; 227/140; 227/145; 227/152; 227/111

(58) Field of Search ..... 227/2, 3, 4, 5, 227/6, 7, 152, 154, 110, 111, 140, 145

(56) References Cited

U.S. PATENT DOCUMENTS 4,392,599 * 7/1983 Russell ..... 227/111
4,679,291 7/1987 Schmeal .
4,876,787 * 10/1989 Ditty et al. ..... 227/2
5,605,270 * 2/1997 Dunn ..... 227/140
5,816,467 * 10/1998 Dunn ..... 227/152

* cited by examiner

*Primary Examiner*—Scott A. Smith
(74) *Attorney, Agent, or Firm*—Guido Modiano; Albert Josif; Daniel O'Byrne

(57) ABSTRACT

An apparatus for inserting, in the molding of picture-frames, metal staples adapted to retain laminar backing elements for pictures, photographs and the like, comprising a beam which is arranged horizontally above the surface that supports the molding, two fixing tools which are guided on the beam transversely to two opposite sides of the molding, an actuation for adjusting the distance between the fixing tools along the beam as a function of the distance between the sides, and a further actuation for vertically actuating the fixing tools into the position for applying metallic staples in the sides.

7 Claims, 6 Drawing Sheets

APPARATUS FOR INSERTING METAL BACKING ELEMENT RETAINING STAPLES IN THE MOLDING OF PICTURE-FRAMES

BACKGROUND OF THE INVENTION

The present invention relates to an apparatus for inserting, in the molding of frames, metal staples adapted to retain laminar supporting elements for pictures, photographs and the like.

It is known that in order to frame pictures there are commercially available frames which comprise a rectangular molding formed by assembled strips which are internally provided with a flange which acts as abutment for the glass plate designed to protect the picture to be framed and for a panel of cardboard or the like adapted to support the picture at the rear. In order to retain the panel and the glass plate within the frame, flexible metal staples are inserted behind the panel by means of a mechanical or pneumatic fixing tool which is usually of the manual type.

The staples are inserted only partially, so as to have an end which protrudes toward the inside of the frame so that it can be folded back when the panel is to be removed or folded forward again in order to reposition the panel.

SUMMARY OF THE INVENTION

The aim of the present invention is to provide an apparatus by means of which the cardboard and the glass plate can be fixed automatically within a picture-frame molding.

This aim is achieved with an apparatus for inserting, in the molding of picture-frames, metal staples adapted to retain laminar backing elements for pictures, photographs and the like, characterized in that it comprises a beam which is arranged horizontally above the surface that supports said molding, two fixing tools which are guided on said beam transversely to two opposite sides of said molding, means for adjusting the distance between said fixing tools along said beam as a function of the distance between said sides, and means for vertically actuating said fixing tools into the position for applying metallic staples in said sides.

BRIEF DESCRIPTION OF THE DRAWINGS

Further characteristics and advantages of the present invention will become apparent from the following detailed description of a preferred embodiment, illustrated only by way of non-limitative example in the accompanying drawings, wherein.

DESCRIPTION OF THE PREFERRED EMBODIMENTS

Figure 1:
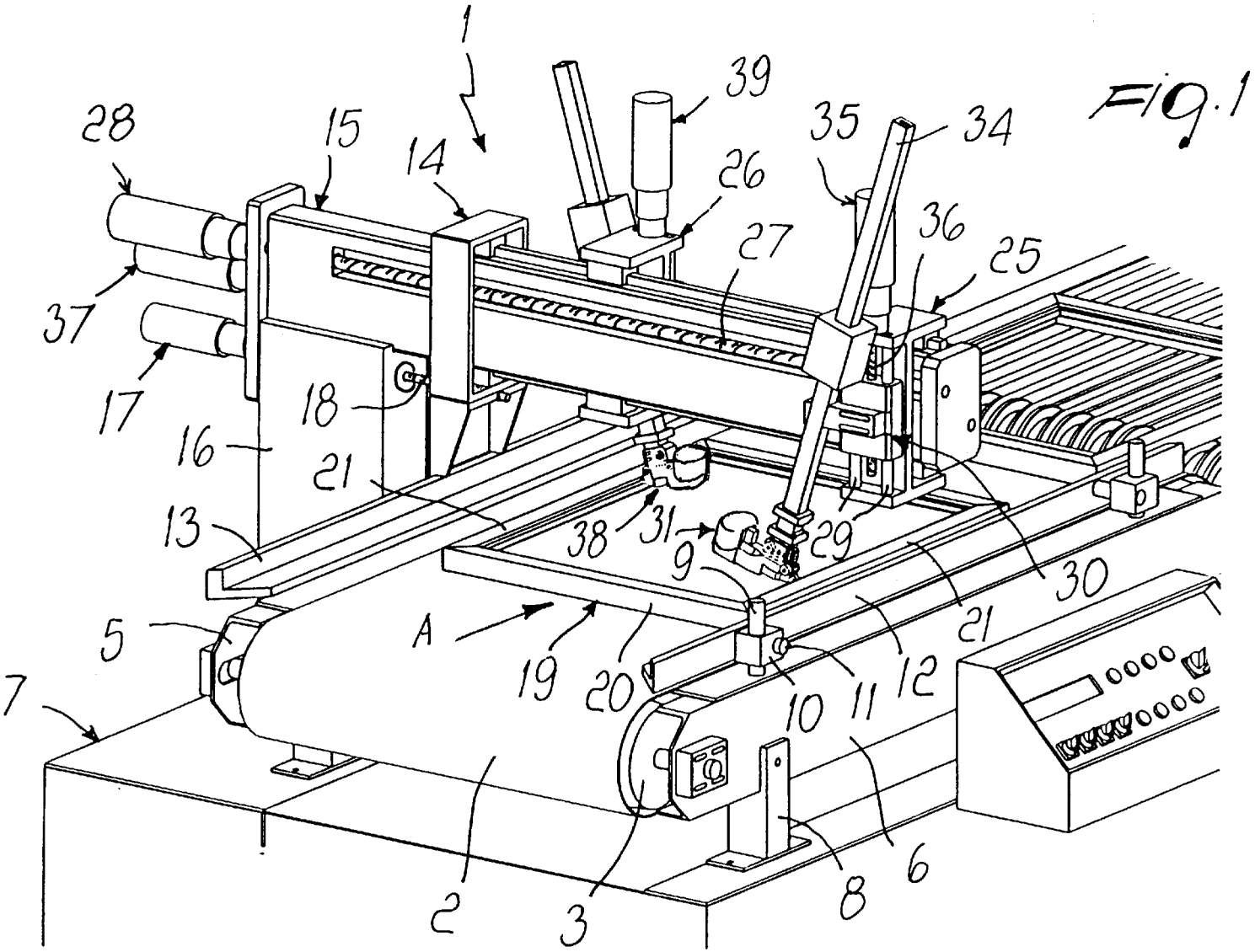
FIGS. 1 and 2 are perspective views of the apparatus.

With reference to FIGS. 1–6, the apparatus is generally designated by the reference numeral 1 and comprises a conveyor for supporting and conveying the frames which is constituted by a belt 2 which is closed in a loop around two rollers 3 and 4; the roller 4 is actuated in order to drive the belt with a continuous motion in the direction A. The rollers 3 and 4 are rotatably supported in sides 5 and 6 which rest on the footing 7 by means of spacers 8.

Two vertical posts 9 rise from the side 6 and blocks 10 can slide thereon. Respective stems 11 are guided in the blocks 10 at right angles to the direction A, and a guiding edge 12 is fixed thereto.

In this manner, by moving and fixing the blocks 10 on the posts 9 and the stems 11 in the blocks 10 it is possible to adjust the edge 12 vertically and laterally.

On the opposite side of the belt 2 with respect to the guiding edge 12 there is another guiding edge 13 which is parallel to the edge 12.

The guiding edge 13 is fixed, in a downward region, to a carriage 14 which is guided on a beam 15 running horizontally and at right angles to the direction A above the belt 2.

The beam 15 cantilevers out from the top of a column 16 which rises from the footing 7 externally with respect to the side 5.

The carriage 14 can be positioned on the beam 15 by means of a drive which comprises a reversible motor 17 which is supported in a cantilevered arrangement by the column 16 and actuates a threaded rod 18 which is engaged in the carriage 14 below the beam 15. By actuating the rod 18 in one direction or the other it is possible to move the edge 13 closer or further away with respect to the edge 12, depending on the width of the frame to be prepared.

Figure 2:
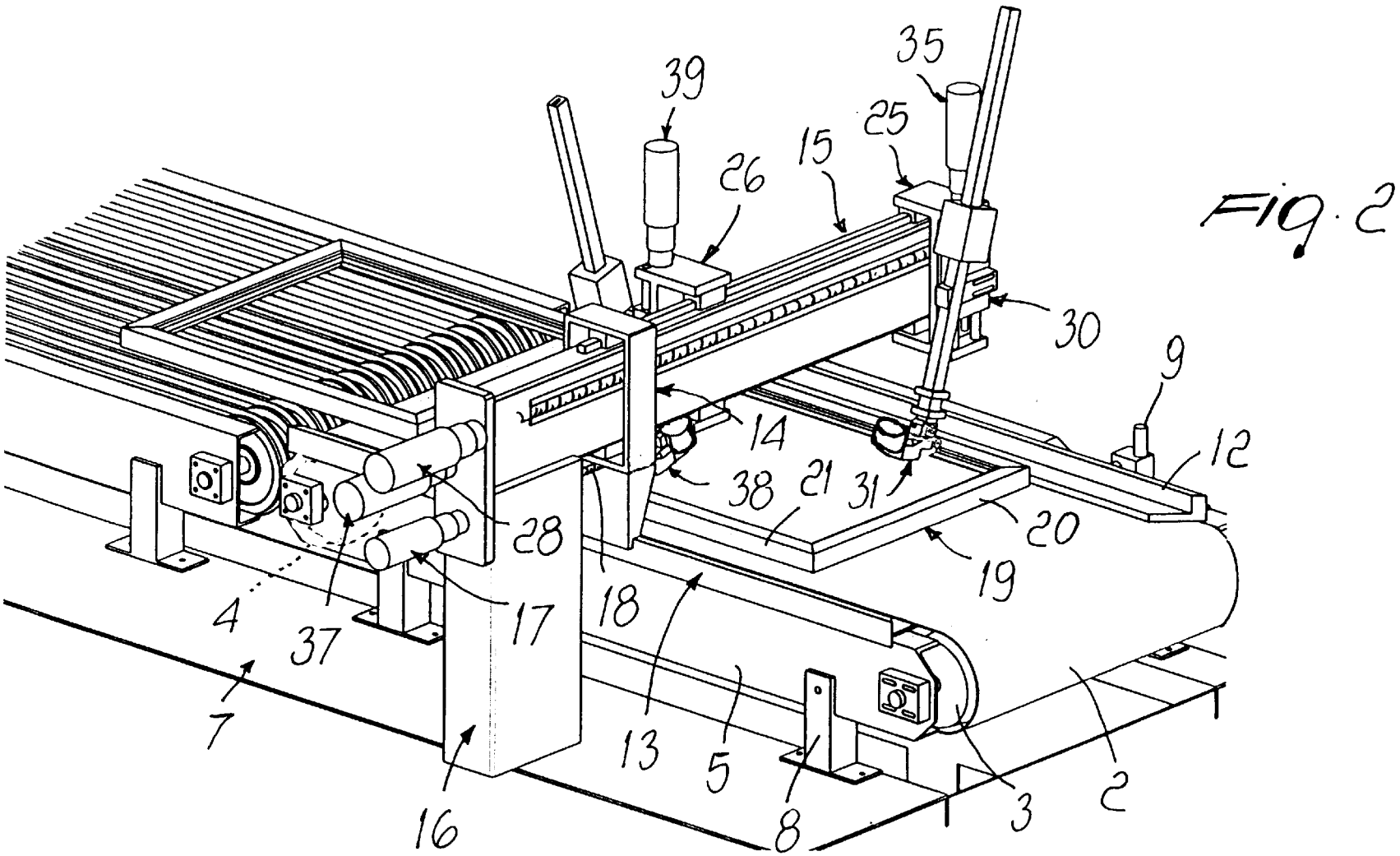
Figure 3:
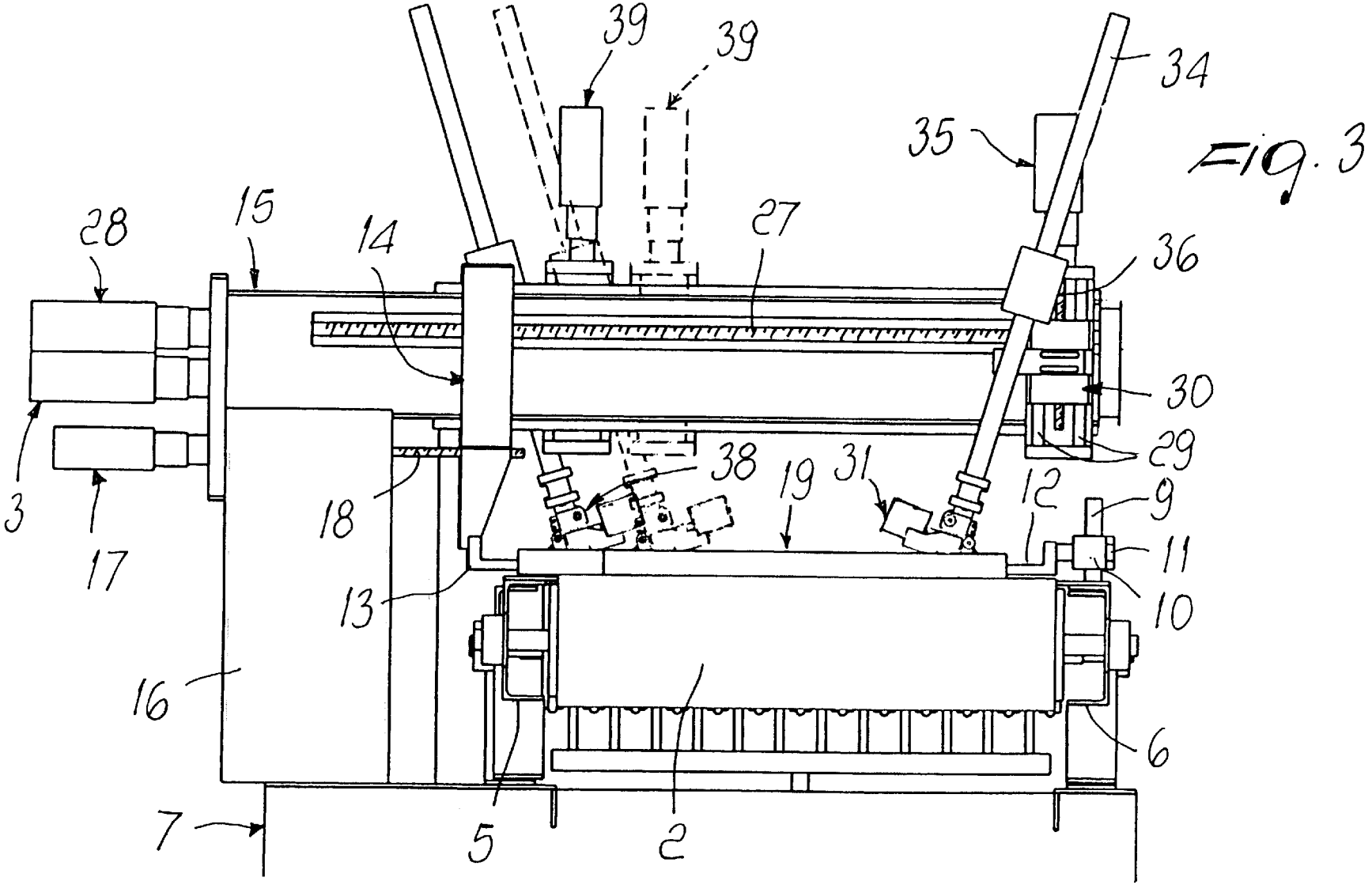
FIG. 3 is a front view of the apparatus of FIGS. 1 and 2.

In FIGS. 1–3, the frame comprises a conventional rectangular molding 19 made of wood or other similar material, which is composed by joining at right angles two transverse strips 20 and two longitudinal strips 21. The strips 20, 21 have a cross-section which forms a flange 22 (see FIG. 4) which lies inside the molding 19 and whereon there rest, for example, a glass plate 23 and a rear panel 24, between which the picture to be framed is to be interposed. The glass plate may of course be omitted and the panel may have any kind of structure. In FIGS. 1–3, the panel that closes the frame to the rear is not shown for the sake of clarity.

In addition to the carriage 14, two sliding blocks 25, 26 are slidingly supported on the beam 15.

The sliding block 25 can move along the beam through a transmission system which comprises a threaded stem 27 which lies within a seat of the beam 15 and is actuated by a reversible motor 28. The stem 27 is rotatably engaged in the sliding block 25, so that by actuating the motor 28 the sliding block 25 can be moved along the beam 15 in one direction or the other.

Two brackets protrude laterally to the beam 15 from the sliding block 25 and two parallel and vertical guiding rods 29 are fixed between them. A slider 30 is slidingly guided on the rods 29, and a fixing tool 31 of the conventional type is rigidly fixed on said slider. The fixing tool 31 comprises an insertion head 32 (see FIG. 4) which has a nozzle 33 for firing the metal staples to be driven into the molding, said staples being joined so as to form a pack which is accommodated in the magazine 34.

The slider 30 can be raised and lowered along the guiding rods 29 of the sliding block 25 by means of a transmission system which is composed of a reversible motor 35 which actuates a threaded stem 36 which is parallel to the guiding rods 29 and is rotatably engaged in the slider 30.

The sliding block 26 is actuated along the beam 15 exactly like the sliding block 25 by means of a reversible motor 37 and a threaded stem (not shown in the drawing) which is actuated by the motor 37 and engages the sliding block 26 with a screw-type coupling.

The sliding block 26 also supports a fixing tool 38 which is fitted on a slider which can be positioned vertically by means of a transmission system which is fully identical to the transmission system that actuates the slider 30 and is actuated by a reversible motor 39. Only the motor 39 of said transmission system is shown in the drawing; said motor actuates, by means of the threaded stem, the lifting of the slider on which the fixing tool 38 is fitted.

The fixing tools 31, 38 are orientated so that by descending from a raised position by means of the motors 35, 39 the nozzles of said fixing tools are directed toward the internal face 40 of the longitudinal strips 21 of the molding, above the rear panel 24.

The operation of the above-described apparatus is as follows.

Assume an initial position in which the guiding edge 13 is already arranged, with respect to the opposite guiding edge 12, at a distance which allows to guide the molding 19 between them without appreciable transverse plays with respect to the advancement direction A. Assume, furthermore, that the nozzles of the fixing tools 31, 38 are vertically aligned on the internal flanges 22 of the longitudinal strips 21 and are raised with respect to the level of the belt 2, so as to allow the molding 19 to pass below them.

In this situation, when a molding 19 has been conveyed by the belt 2 until it reaches the position in which the fixing tools 31 are arranged inside the molding, the motors 35 and 39 are activated so as to lower the sliders 30 to a level at which the nozzles 33 of the fixing tools 31, 38 are engaged in the corner formed by the panel 24 and by the internal face 40 for containing the panel 24 on the flange 22.

At this point, the fixing tools 31, 38 are activated and drive the staples into the longitudinal strips 21, thus locking said panels 24 against the flange 22 with the glass plate 23 interposed. Once this step for the insertion of the metal staples has been completed, the fixing tools 31, 38 are again raised above the molding 19, so as to allow it to continue further. A prerogative of the present invention is the fact that the arrangement of the fixing tools 31, 38 at the level for inserting the staples can be achieved by means of adapted sensors which, after detecting the presence of the molding 19 on the belt 2, actuate the gearmotors 35, 39 so as to lower the fixing tools 31, 38.

In a preferred embodiment of the invention, conceived in order to adapt the apparatus to the width of the moldings, particularly when it is necessary to work with molding of different sizes, provisions are made for the use of additional sensors which are capable of detecting the transverse dimensions of the moldings 19 conveyed by the belt 20 and to accordingly actuate the gearmotors 17, 28, 37 so as to adapt the distance between the guiding edges 13 and 12 to the width of the molding as detected by the sensors and move the sliding blocks 25, 26 so as to achieve the vertical alignment of the nozzles of the fixing units 31, 38 on the flanges 22 at the longitudinal strips 21.

The above-described apparatus can be operatively associated with another identical one in order to produce a unit which allows to insert metal staples on all the sides of the molding.

Figure 5:
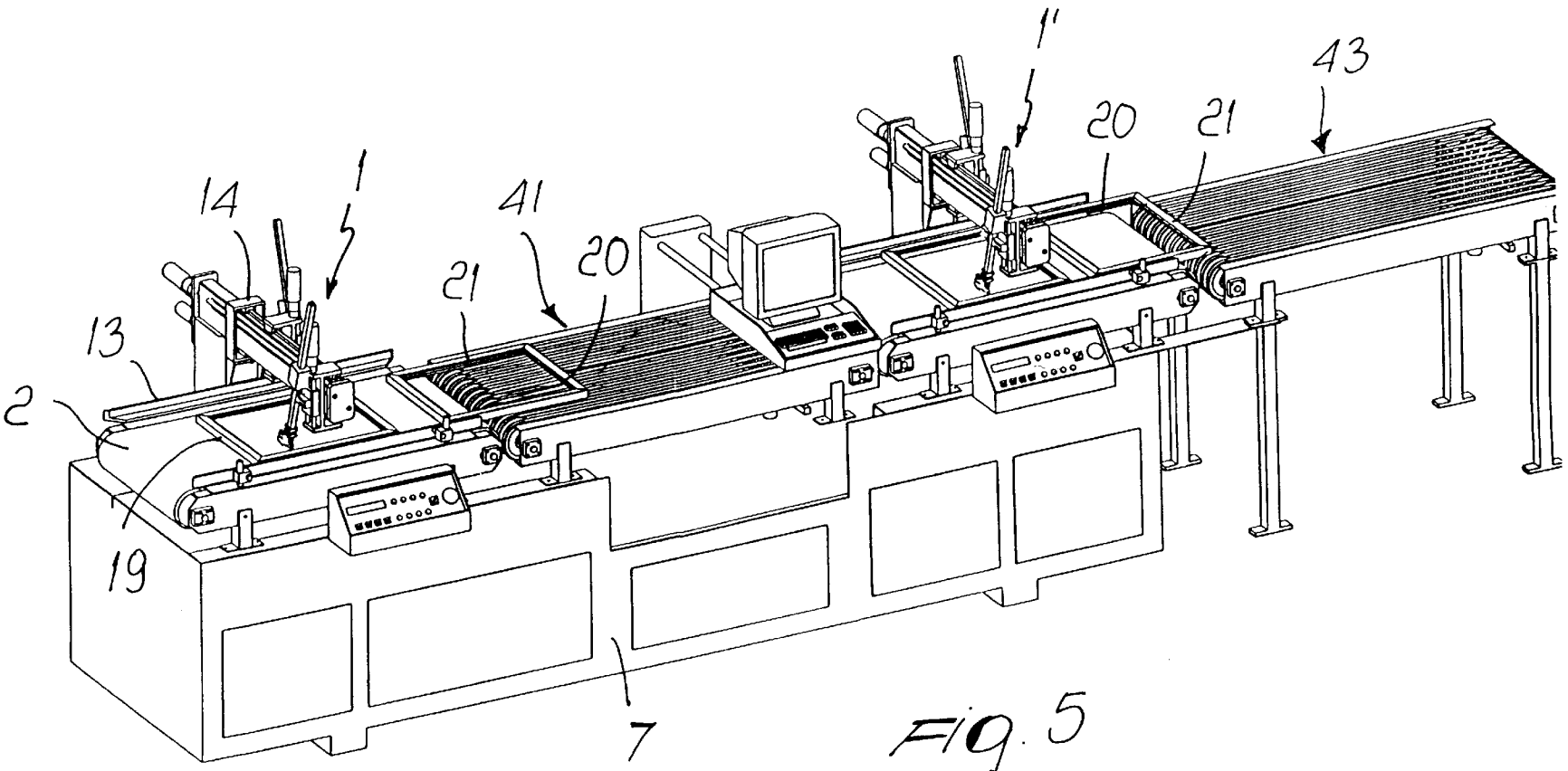
FIG. 5 is a perspective view of an apparatus provided by combining in an in-line configuration two apparatuses according to FIGS. 1–4 for automatically preparing frames.
Figure 6:
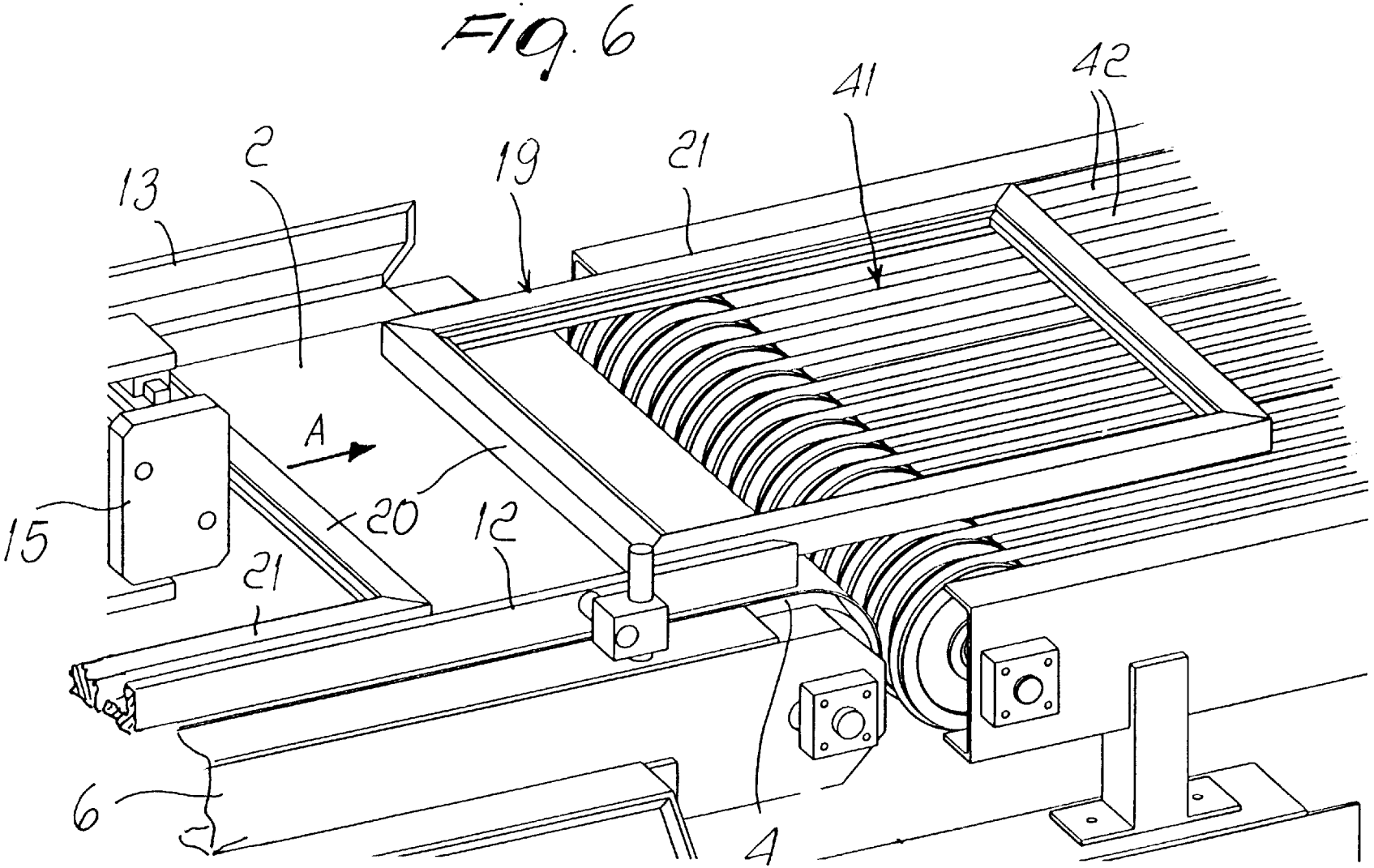
FIG. 6 is an enlarged-scale view of a detail of the apparatus of FIG. 5.

For this purpose, as shown in FIG. 5, at the outlet of the belt 2 of a first apparatus 1 there is a turntable 41 which is capable of turning through 90° the moldings transferred onto it by the belt 2. Advantageously, the turntable 41 is constituted by a plurality of belts 42 (see FIG. 6) which are closed in a loop around corresponding pulleys and whose upper portion forms a supporting surface for the moldings 19 that arrive from the belt 2. The belts are actuated with a decreasing motion from one side to the other, so as to turn through 90° the molding that rests temporarily on them, so that the longitudinal strips 21 arrange themselves transversely to the advancement direction A. Downstream of the turntable 41 there is a second apparatus 1' which inserts the metal staples on the transverse strips 20, which are now longitudinal. At the output of the second apparatus 1 there is a conveyor 43 which removes the completed moldings. Optionally, instead of the conveyor 43 it is possible to provide an additional turntable in order to return the moldings to the initial arrangement.

Figure 7:
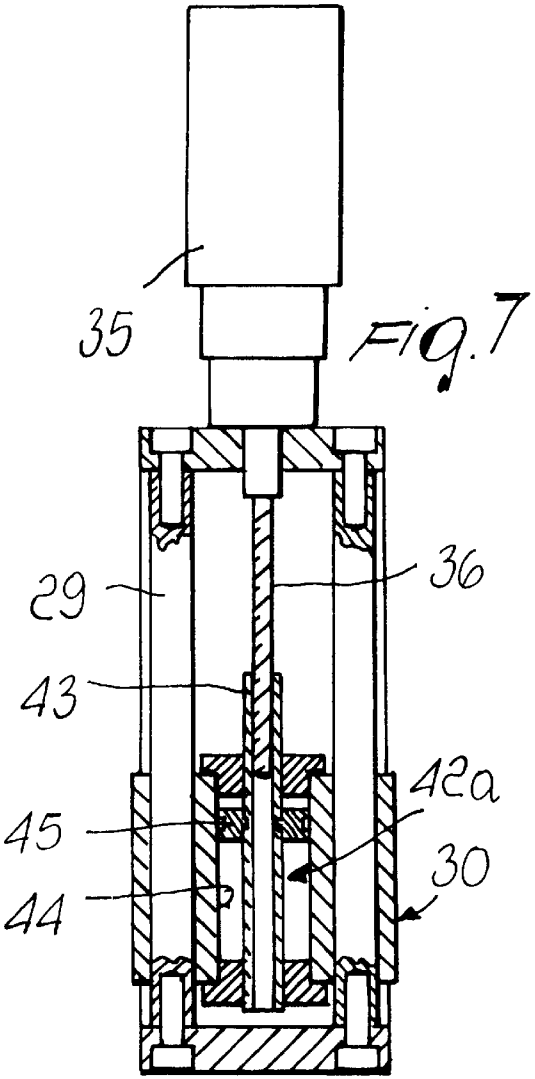
FIG. 7 is a sectional view of a further embodiment of the apparatus.
Figure 4:
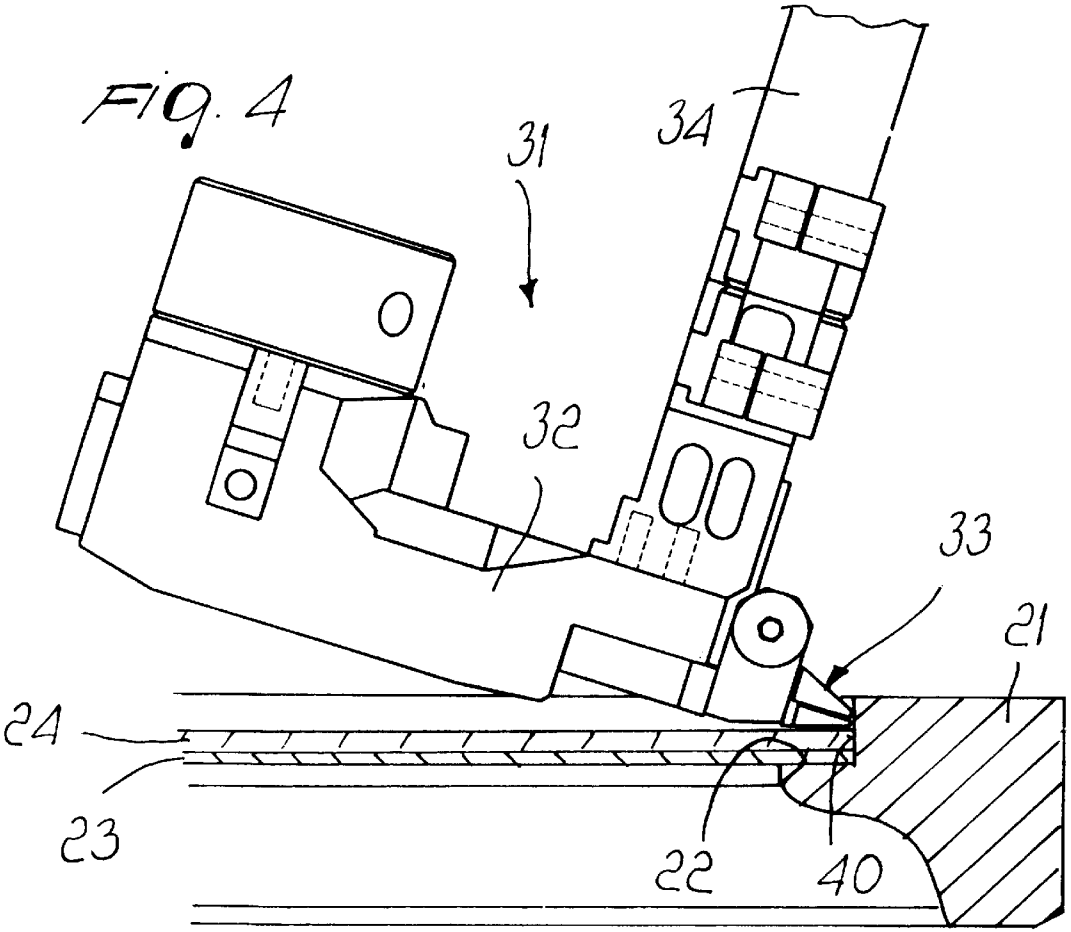
FIG. 4 is a view of the head of the fixing tool in the position for inserting the staples in the molding.

FIG. 7 is a sectional view of a further embodiment of the invention, in which the lifting and lowering of the slider 30 by means of the threaded stem 36 is combined with the movement actuated by a pneumatic cylinder 42*a*.

For this purpose, the threaded stem 36 is screwed into a tube 43 which is guided axially, but retained rotationally, through a cylindrical cavity 44 formed in the slider 30. A piston 45 is rigidly coupled on the tube 43 and divides the cavity 44 into two chambers. By feeding compressed air to the upper or lower chamber, the slider 30 is made to rise or descend, respectively. This allows to use the motors 35, 39 for molding size changes and the pneumatic cylinders for raising and lowering the fixing tools during normal working conditions.

In practice, the turntable 41 is provided with guiding edges in order to facilitate and improve the precision of the rotation of the moldings in transit.

Advantageously, the speed at which the frames move on the turntable is at least twice the speed with which the frames advance on the conveyor of the apparatuses for inserting the fixing elements, in order to allow correct mutual spacing of the frames and their rotation through 90°.

The disclosures in Italian Patent Application No. BO99A000013 from which this application claims priority are incorporated herein by reference.

What is claimed is:

1. An apparatus for inserting, in moldings of picture-frames, metal backing element retaining staples comprising: a surface for supporting a molding; a beam arranged horizontally above said supporting surface; two fixing tools guided on said beam transversely to two opposite sides of said molding; first actuation means for adjusting a distance between said fixing tools along said beam as a function of a distance between said sides; and second actuation means for vertically actuating said fixing tools into a position for applying metallic staples in said molding sides.

2. The apparatus of claim 1, further comprising: sliding blocks movable along said beam; sliders on which said fixing tools are fixed and which are vertically guided on respective ones of sliding blocks; said second actuation means moving said sliders on said sliding blocks between a raised position, which allows passage of said molding below said fixing tools, and a lowered position for applying said metal staples to the opposite sides of said molding.

3. The apparatus of claim 2, comprising a carriage guided on said beam, and driving means for driving said carriage along said beam, said supporting surface being constituted by a belt for transferring the molding below said fixing tools, said belt being delimited on one side by a first edge which forms a lateral reference guide for said molding and, on the other side, by a second edge which is supported by said carriage.

4. The apparatus of claim 3, comprising sensors for controlling said first and second actuation means and said driving means while moving said sliding blocks, said sliders and said carriage respectively, said sensors being adapted to detect both presence and dimensional data of said molding, on said belt.

5. The apparatus of claim 4, wherein each one of said first and second actuation and driving means is constituted by a threaded stem which engages said carriage, said sliding blocks and said sliders, respectively, said threaded stems being actuated each by a motor controlled by said sensors.

6. The apparatus of claim 5, comprising a fluid-driven cylinder; a tube guided axially, but retained rotationally, through a cylindrical cavity which is formed in said slider; said threaded stem being screwed into said tube; a piston being rigidly coupled on said tube so as to divide said cavity into two chambers which can be connected to a source of compressed air, and wherein lifting and lowering of said slider by way of said threaded stem is combined with a movement which is actuated by said fluid-driven cylinder.

7. An apparatus for inserting, in moldings of picture-frames, metal backing element retention staples comprising: two in-line apparatuses as claimed in claim 1; a turntable being interposed between said apparatuses, said turntable rotating through a 90° angle, the moldings that arrive from a first apparatus and to transfer the moldings to a second downstream apparatus of said two in-line apparatuses.

* * * * *